United States Patent [19]

Huber

[11] 4,441,656

[45] Apr. 10, 1984

[54] ELECTROSTATIC DISABLING SWITCH FOR ELECTROSTATIC SPRAY GUNS

[75] Inventor: Willi Huber, Heerbrugg, Switzerland

[73] Assignee: J. Wagner AG, Switzerland

[21] Appl. No.: 343,812

[22] Filed: Jan. 29, 1982

[51] Int. Cl.[3] ..... B05B 5/02

[52] U.S. Cl. ..... 239/708; 239/289

[58] Field of Search ..... 239/690–708, 239/289; 200/61.85, 157; 335/151, 154

[56] References Cited

U.S. PATENT DOCUMENTS 3,504,235 3/1970 Lee ..... 335/154

4,287,552 9/1981 Wagner et al. ..... 239/708 X

*Primary Examiner*—John J. Love

*Assistant Examiner*—Mary McCarthy

*Attorney, Agent, or Firm*—Hill, Van Santen, Steadman & Simpson

[57] ABSTRACT

An electrostatic spray gun is provided with electrostatic power circuitry for supplying high voltage power to an electrode with a switch for enabling and disabling the circuitry, the switch being operated by movement of a trigger controlling flow of a coating fluid through the spray pistol. The switch is a magnetic switch normally open, but closeable by a magnet positioned adjacent the switch, the trigger having means to shunt the magnetic field allowing the switch to open when the trigger is closed and allowing the switch to close when the trigger is open. A second magnet is provided movable towards and away from the first magnet whereby the second magnet effectively shunts the magnetic force of the first magnet when moved adjacent thereto to prevent closure of the switch independent of movement of the trigger.

10 Claims, 6 Drawing Figures

FIG. 1
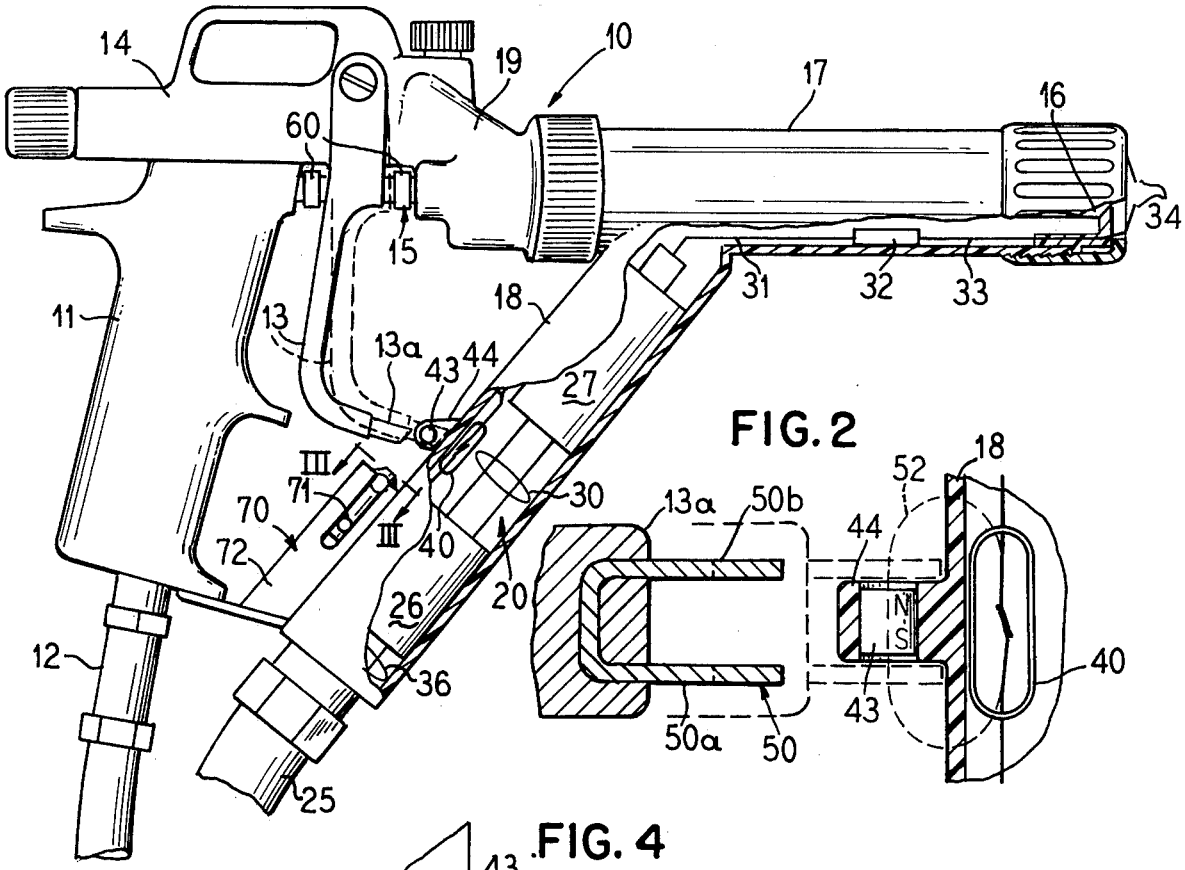
FIG. 2
FIG. 3
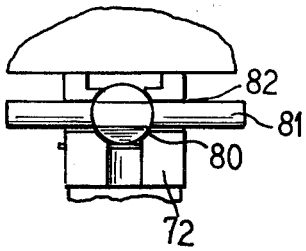
FIG. 4
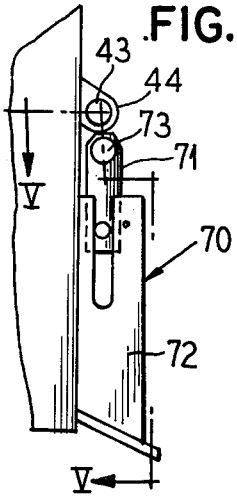
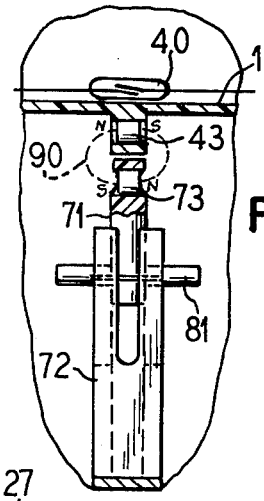
FIG. 5
FIG. 6
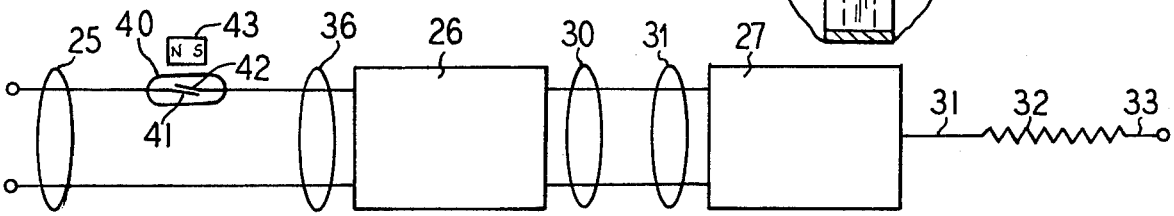

ELECTROSTATIC DISABLING SWITCH FOR ELECTROSTATIC SPRAY GUNS

BACKGROUND OF THE INVENTION

1. Field of the Invention

This invention relates to electrostatic spray coating systems, and more particularly to switch means for electrostatic coating systems.

2. Prior Art

Electrostatic spray coating systems of the type in which this invention is employed are shown, for example, in U.S. Pat. Ser. No. 4,287,552, issued to Josef Wagner and Willi Huber, Sept. 1, 1981, the teachings of which are incorporated herein by reference.

In such systems, particularly in trigger operated systems, movement of the trigger controlling the coating spray valve also actuates switch means controlling the electrostatic circuitry. In hand-held units having manually actuated trigger means, the electrostatic circuitry includes components formed in a trigger guard. Those components may include a proximity switch which is activated in dependent response to positioning of an end of the trigger adjacent the trigger guard. Thus, when the rocking trigger is in the valve closed position with the free end of the trigger moved furthest away from the pistol grip or pistol handle, the proximity switch, in response to the presence of the trigger handle, will be disabled to a circuit breaking condition thereby discontinuing supply of high voltage power to the electrode adjacent the spray orifice. Movement of the trigger away from the trigger guard towards a spray valve opening position will cause the switch to close thereby establishing power output at the electrode.

Such trigger actuated switching is desirable in that it eliminates the necessity of additional manually operated switch means to control the on-off of the power supply to the electrode while assuring that the electrode power will normally be terminated when spraying is not taking place. Moreover, by use of a proximity switch or similar device, initial movement of the trigger can actuate the power circuitry prior to beginning to open the spray valve. This will assure that there is always an electrostatic field present during spraying.

However, it is sometimes desirable to utilize the coating spraying system without the electrostatic field. For example, in one sided coating the existence of an electrostatic field would provide a wrap around coating which would coat the opposite side of the piece being sprayed. In such instances it is therefore desirable to deactivate the electrostatic field. However, when spraying mixed articles where some spraying is to be done with the electrostatic field and some without, the operator is required to leave the immediate spray booth area and move to the main control for the electrostatic to either activate it or deactivate it. This can result in substantial time delays. It would therefore be an advance in the art to provide an electrostatic paint spray device having a trigger activated electrostatic circuitry switch with means at the spray device to prevent activation of the circuitry when desired irrespective of trigger movement.

SUMMARY OF THE INVENTION

The above disadvantages described in connection with prior art systems are overcome by the present invention. The present system utilizes a spray pistol having electrostatic field circuitry contained, in part, in a trigger guard member lying opposite the trigger such that movement of the trigger from a deactivated position to an activated position to cause coating flow will cause the trigger to move away from the trigger guard. A reed switch is provided internally of the trigger guard and a magnet is provided on a surface of the trigger guard adjacent a free end of the trigger. The trigger end is provided with a shunt for the magnetic field such that when the trigger is in the relaxed, no coating flow state, the shunt lies adjacent the magnet. In this manner, the magnetic field from the magnet is shunted through the trigger shunt and does not effect the switch interior of the trigger guard. Upon removal of the shunt by pivoting of the trigger away from the trigger guard, the magnetic field will be freed from the effect of the shunt and will activate the switch.

In order to provide selective deactivation of the magnetic switch activation system which, for example, would be desired when spraying in a faraday cage atmosphere, a secondary magnet having poles opposite the switch magnet is carriage mounted to the trigger guard. The carriage has two positions of repose, the first with the secondary magnet spaced a sufficient distance from the switch magnet to have substantially no effect on the field of the switch magnet. The second position of repose places the secondary magnet adjacent the switch magnet where, due to its opposite polarity, the magnetic field of the switch magnet is redirected primarily externally of the trigger guard between the two magnets, thereby preventing activation of the electrostatic circuitry upon removal of the trigger shunt.

The carriage is preferably manually movable and positions the secondary magnet when in the second position of repose in an area where it will not interfere with movement of the trigger.

It is therefore an object of this invention to provide an improved electrostatic paint spray device.

It is another object of this invention to provide an electrostatic spray pistol having a trigger activated electrostatic circuitry including a magnetically actuated proximity switch activated by movement of the spray valve trigger with manually operable means to selectively prevent actuation of the switch independent of movement of the trigger.

It is another and more specific object of this invention to provide an electrostatic coating spray pistol having a trigger guard with a magnetically operated switch positioned interior of the trigger guard, a magnet positioned exterior of the trigger guard adjacent a position of the free end of the trigger when the trigger is in a valve closed, no spray condition, the free end of the trigger being provided with a shunt for the field of the magnet, the shunt being movable to a position of substantial non-interference with the magnetic field upon movement of the trigger towards the spraying position, and a manually movable secondary magnet movable from a position remote from the switch magnet to a position adjacent the switch magnet for preventing activation of the electrostatic circuitry irrespective of movement of the trigger shunt.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a side elevational view, partially broken away showing internal structure, of a hand-held spray pistol incorporating the invention.

FIG. 2 is a diagrammatic sectional view of the switch area and trigger shunt of the pistol of FIG. 1.

FIG. 3 is a view taken along the lines III—III of FIG. 1.

FIG. 4 is a side view of the switch activation disabler of this invention.

FIG. 5 is a view taken along the lines V—V of FIG. 4.

FIG. 6 is a schematic diagram of the electronics in the spray gun of FIG. 1.

DESCRIPTION OF THE PREFERRED EMBODIMENTS

FIG. 1 illustrates an electrostatic coating spray pistol 10 of the type generally used for spraying paints, lacquers, varnishes and other coatings. The pistol includes a handle or grip portion 11 having a conduit 12 for supplying coating under pressure to the pistol, a trigger 13 pivoted to a valve actuator 14 which controls actuation of a valve assembly 15 for controlling flow of coating fluid to an orifice 16. The orifice 16 is at the end of a barrel 17 which projects forwardly of the grip 11. The barrel has a depending portion 18 which forms a trigger guard defining a somewhat triangular enclosed area between the spray gun body portion 19, the grip 11, the barrel 17 and the trigger guard 18 in which the trigger 13 pivotably reciprocates. The trigger guard 18 contains electrostatic circuitry components 20 in a hollow interior thereof. An electronic cable 25 supplies low voltage, intermediate frequency current to a step-up transformer 26 which in turn supplies an output 30 to an input 31 to a high voltage multiplier circuit 27. The output of the high voltage multiplier circuit is to conductor 31, resistor 32 and conductor 33. Conductor 33 is connected to electrodes 34 for providing an electrostatic field adjacent the orifice 16 end of the barrel 17.

In the circuit intermediate the input from the cable 25 and the input 36 to the step-up transformer 26, a switch 40 is provided. The switch 40 is preferably positioned interiorly of the trigger guard 18 where it is protected from the environment. Preferably the switch 40 is a proximity switch. By use of the terminology proximity switch, it is intended to include all switch devices which can be activated by a non-mechanical contact. In the preferred embodiment illustrated, the switch 40 is a magnetic reed switch having contacts 41 and 42 which may, for example, be normally open and closeable when subjected to the magnetic field of an external magnet 43. In the preferred embodiment, a switch actuating magnet 43 is mounted on the exterior of the trigger guard 18 in a boss 44 projecting from the trigger guard in the direction of the trigger.

The trigger has a free end 13*a* equipped with a shunt 50. As best shown in FIG. 2, when the shunt 50 is in the broken line position, legs 50*a* and 50*b* of the shunt lie on opposite sides of the magnet 43 adjacent the polarized end faces thereof. In such a situation, the majority of the magnetic field generated by the magnet will be directed through the shunt. When the shunt is moved away from the magnet, as by pulling on the trigger to move it from the broken lines of FIG. 1 to the solid lines of FIG. 1, the shunt 50 will be moved away from the magnet, as illustrated by the solid line section in FIG. 2. At such time, the magnetic field of the magnet 43 will no longer be primarily influenced by the shunt and the magnetic field 52 will now influence the switch 40 sufficient to close the contacts to activate the electrostatic circuitry. Upon a return of the shunt from the solid line position of FIGS. 1 and 2 to the broken line position of FIGS. 1 and 2, the magnetic field will be redirected primarily through the shunt leaving an inadequate field force at the switch 40 resulting in a break of the contacts. This deactivates the electrostatic circuitry. Thus, it can be seen with a construction of this type, that it is not necessary to have the electrostatic field turned on at all times, and, in fact, the electrostatic field is turned on only when the trigger is withdrawn towards the coating valve opening position. If desired, the trigger can have an amount of free play determined, for example, by placement of nuts 60 on the valve actuator 15 which allows the trigger to be withdrawn from the rest or full open position of the dotted lines of FIGS. 1 and 2 to an intermediate position where the electrostatic circuitry is activated, but where the spray valve is still closed. Further withdrawal of the trigger will open the spray valve.

Since this construction provides one handed on-off operation of both the coating spray and the electrostatic field, operator fatigue and mistake is minimized and power consumption is reduced.

However, at certain times it may be desired to spray coating through the pistol without activating the electrostatic circuitry. Examples of such occasions include when it is desired to spray into a faraday cage atmosphere or when it is desired to eliminate the wrap around effect of the coating on an article, or where the spray is being made so close to the article that the possibility of grounding precludes the use of the electrostatic field. In such instances, this invention provides a disabling mechanism on the spray gun to preclude activation of the circuitry. The disabling mechanism 70 in the preferred embodiment includes a carriage member 71 received in a housing 72. The carriage member 71 is provided with a second magnet 73 adjacent an end of the carriage. The carriage member is movable towards and away from the magnet 43.

In the preferred embodiment illustrated, the carriage member 71 is a rod-like member received in a longitudinal bore 80 of the housing 72, the housing being affixed to the back side of the trigger guard below the magnet boss 44. A cross arm 81 projects out of side slots 82 of the housing, the cross arm being affixed to the rod-like carriage member 71. The magnet 73 is embedded in a bore in the rod adjacent its end. In this manner, the rod can be telescopically projected from and retracted into the bore 80 by manual movement of the cross rod 81. At its position of fullest projection, illustrated in FIG. 4, the magnet 73 will lie closely adjacent the magnet 43. In this position, as illustrated in FIG. 5, the mutual magnetic fields 90 of the magnets 43 and 73 will be between the magnets principally externally of the trigger guard 18 due to the opposite polarity of the magnets' ends. Thus, the magnet field of the magnet 43 interior of the trigger guard 18 in the area of the switch 40 will be insufficient to activate the switch 40 irrespective of movement of the trigger 13.

By use of a U-shaped shunt 50 on the free end 13*a* of the trigger, and further by use of a rod-like carriage 71 together with a magnet 73 comparably sized with the magnet 43, it can be assured that the shunt can clear both the projected rod and magnet, 71, 73, as well as the magnet 43 and magnet boss 44. Thus, projection of the carriage 71 does not in any way interfere with movement of the trigger.

It will therefore be appreciated from the above that this invention provides both a method and device for activating the electrostatic circuitry in dependent response to movement of the mechanism for activating coating spraying as well as a method and device for disabling the activating mechanism to preclude activation of the circuitry independent of movement of the spray initiating mechanism. In the preferred embodiment this is accomplished without the use of mechanically actuated switches and through the intermediary of a magnetically activated switch and a pair of magnets, one of which is movable towards and away from the other magnet to redirect the magnetic field of the switch activating other magnet.

Although the teachings of my invention have herein been discussed with reference to specific theories and embodiments, it is to be understood that these are by way of illustration only and that others may wish to utilize my invention in different designs or applications.

I claim as my invention:

1. In an electrostatic spray device having an electrode and power supply circuitry for the electrode, a coating supply conduit terminating at an orifice means and a valve controlling flow through the orifice, switch means for activating the power supply, said switch means and valve being activated by movement of a trigger means, the improvement of the switch means being magnetically operated by a magnet means, an activating means on the trigger means for effecting the magnet means to activate the switch means in dependent response to movement of the trigger means and a second magnet means carried by the device movable towards and away from the switch means to override the trigger means activating means to prevent trigger means movement actuation of the switch means.

2. A control device for an electrostatic coating spraying gun comprising electro-power circuitry for providing a charge to a gun carried electrode, switch means in said circuitry, magnet means to actuate the switch means, second magnet means for preventing actuation of the switch means by the magnet means, said second magnet means carried by the gun and movable from a non-actuation preventing first position to actuation preventing second position and means to move the second magnet means between the first and second positions.

3. A device according to claim 2 wherein the switch means is a magnetically actuated reed switch.

4. A device according to claim 3 wherein the magnet means includes a first magnet having a field and means to selectively apply the field to the switch means.

5. A device according to claim 4 wherein the first magnet is physically positioned adjacent the switch, a movable shunt on said gun, said shunt movable from a first position adjacent the first magnet to a second position remote from the first magnet.

6. A device according to claim 5 wherein said gun includes a movable trigger, said shunt is carried by said trigger, said trigger controls a coating spray control valve and movement of said trigger to control the coating spray control valve moves said shunt from a switch deactuated position adjacent said first magnet to a switch actuated position remote from said said first magnet, said shunt effective to direct said first magnet field away from the switch when in said switch deactuated position.

7. A device according to claim 6 wherein the second magnet means includes a second magnet having a field, the means to move the second magnet means provides movement of the second magnet from the first position to the second position, the second position positioning the second magnet adjacent the first magnet, positioning of the second magnet adjacent the first magnet effective to redirect the magnetic field of the first magnet away from the switch due to the presence of the second magnet at the second position.

8. A device according to claim 4 wherein the second magnet means includes a second magnet having a field, the means to move the second magnet means provides movement of the second magnet from the first position to the second position, the second position positioning the second magnet adjacent the first magnet, positioning of the second magnet adjacent the first magnet effective to redirect the magnetic field of the first magnet away from the switch due to the presence of the second magnet at the second position.

9. A device according to claim 2 wherein the magnet means includes a first magnet having a field and means to selectively apply the field to the switch means, a second magnet means including a second magnet having a field, the second magnet means movable from the first position to a second position adjacent the first magnet, the second magnet, when in the second position effective to redirect the field of the first magnet away from the switch means.

10. An electrostatic coating spraying gun including a gun handle, a gun barrel having a spraying orifice therein and electrodes adjacent the orifice, a trigger guard depending from the barrel spaced from the handle, a pivotable trigger received in the space between the handle and the trigger guard, circuitry for the electrode contained in the trigger guard, a switch controlling said circuitry contained in the trigger guard, a magnet affixed to the trigger guard adjacent the switch having a magnetic field effective to actuate the switch, a shunt carried by an end of the trigger movable with the trigger from a first position adjacent the magnet to a second position remote from the magnet upon movement of the trigger to actuate coating flow through the orifice, the shunt effective to redirect the magnetic field of the magnet away from the switch when in the first position, a second magnet carried by said trigger guard, said second magnet movable from a first position spaced from the magnet to a second position adjacent the magnet, said second magnet effective, when in the second position, to redirect the magnetic field of the magnet away from the said switch irrespective of the positioning of the shunt, and means to move the second magnet.

* * * * *